US009938716B2

(12) United States Patent
Thomson

(10) Patent No.: US 9,938,716 B2
(45) Date of Patent: Apr. 10, 2018

(54) ROOF STRUCTURE

(71) Applicant: ULTRAFRAME (UK) LIMITED, Lancashire (GB)

(72) Inventor: Andrew Thomson, Lancashire (GB)

(73) Assignee: Ultraframe (UK) Limited, Lancashire (GB)

( * ) Notice: Subject to any disclaimer, the term of this patent is extended or adjusted under 35 U.S.C. 154(b) by 0 days.

(21) Appl. No.: 14/783,915

(22) PCT Filed: Apr. 14, 2014

(86) PCT No.: PCT/GB2014/051155
§ 371 (c)(1),
(2) Date: Oct. 12, 2015

(87) PCT Pub. No.: WO2014/167362
PCT Pub. Date: Oct. 16, 2014

(65) Prior Publication Data

US 2016/0069074 A1 Mar. 10, 2016

(30) Foreign Application Priority Data

Apr. 12, 2013 (GB) ..... 1306703.8

(51) Int. Cl.
*E04B 7/00* (2006.01)
*E04B 7/02* (2006.01)
(Continued)

(52) U.S. Cl.
CPC ..... *E04B 7/026* (2013.01); *E04B 7/04* (2013.01); *E04B 7/063* (2013.01); *E04D 3/06* (2013.01);
(Continued)

(58) Field of Classification Search
CPC ..... E04C 2003/043; E04C 2003/0417; E04C 2003/0465; E04C 2003/0469; E04D 3/08;
(Continued)

(56) References Cited

U.S. PATENT DOCUMENTS 8,925,255 B1 * 1/2015 Haun ..... E04D 3/366 52/91.1
9,140,050 B2 * 9/2015 Lindgren ..... E04D 13/031
(Continued)

FOREIGN PATENT DOCUMENTS

FR 2727165 A1 5/1996
GB 2204627 A 11/1988
(Continued)

OTHER PUBLICATIONS

PCT International Search Report dated Jun. 20, 2014 and issued in connection with PCT/GB2014/051155.
(Continued)

*Primary Examiner* — Charles A Fox
*Assistant Examiner* — James J Buckle, Jr.
(74) *Attorney, Agent, or Firm* — Barnes & Thornburg LLP

(57) ABSTRACT

A roof for a building comprises a ridge beam for defining an upper edge of the roof, and a first eaves beam for defining a lower edge of the roof. The roof further comprises a first panel connectable to both the ridge beam and the eaves beam, being capable of spanning the distance therebetween and extending over at least a first portion of the area of the roof. In addition, the roof comprises one or more retention structures positionable relative to the first panel and one of said beams and configured to clamp said panel against the other of said beams.

21 Claims, 13 Drawing Sheets

(51) Int. Cl.

| | |
|---|---|
| ***E04D 3/08*** | (2006.01) |
| ***E04B 7/04*** | (2006.01) |
| ***E04B 7/06*** | (2006.01) |
| ***E04D 3/06*** | (2006.01) |
| *E04C 3/04* | (2006.01) |

(52) U.S. Cl.
CPC ..... *E04D 3/08* (2013.01); *E04B 2007/066* (2013.01); *E04C 2003/043* (2013.01); *E04C 2003/0417* (2013.01); *E04C 2003/0465* (2013.01); *E04C 2003/0469* (2013.01); *E04D 2003/0875* (2013.01); *E04D 2003/0881* (2013.01)

(58) Field of Classification Search
CPC ..... E04D 2003/0875; E04D 2003/0881; E04B 7/04; E04B 7/063; E04B 2007/066
USPC ..... 52/91.1
See application file for complete search history.

(56) References Cited

U.S. PATENT DOCUMENTS

| | | | | |
|---|---|---|---|---|
| 2003/0024175 | A1 | 2/2003 | Jones et al. | |
| 2006/0000161 | A1* | 1/2006 | Darmer ..... | E04D 13/032 52/200 |

FOREIGN PATENT DOCUMENTS

| | | | |
|---|---|---|---|
| GB | 2284836 | A | 6/1995 |
| JP | H0642094 | A | 2/1994 |
| JP | H10115042 | A | 5/1998 |

OTHER PUBLICATIONS

UK Search Report dated Nov. 18, 2013 and issued in connection with UK Priority Application No. 1306703.8.

* cited by examiner

ROOF STRUCTURE

CROSS REFERENCE TO RELATED APPLICATIONS

This application is a U.S. nationalization under 35 U.S.C. § 371 of International Application No. PCT/GB2014/051155, filed Apr. 14, 2014, which claims priority to British Patent Application No. 1306703.8 filed Apr. 12, 2013, the disclosures of both of the foregoing now expressly being incorporated herein by reference.

The present invention relates to a roof structure of the kind that may be used, for example, as a roof for a building extension or a conservatory.

A conventional roof, such as may be used for a house extension, is typically formed from timber framing. Eaves beams run around the perimeter of the roof, on top of the walls defining the structure being roofed, and one or more ridge beams define the top edge(s) of the roof. Sloped rafters may be connected at one of their ends to the eaves beams and at the other end to a ridge beam, supporting it. The arched structure formed by the rafters supports roof insulation and tiling. For increased strength, the rafters are often interconnected by additional beams such as collar ties, wind braces, joists, props and purlins, all of which are well-known in the building construction industry.

In the case of a conventional glazed conservatory roof, again the perimeter of the roof is typically defined by eaves beams and the top edge is defined by one or more ridge beams. Interconnection between the eaves beams and ridge beam(s) is provided by glazing bars, which support sheets of glazing material therebetween. Due to the weight of sheets of glazing material, additional supports, such as tie bars, are often required to ensure that the roof is of sufficient strength.

Conventional beams or glazing bars of the required strength have considerable bulk and weight. Indeed, a structure of sufficient strength to support insulation and tiling and/or glazing may itself be heavy enough that yet further support is required. Not only does this bulk and weight increase the cost of the roof, it can also complicate transport of materials to the site and potentially require heavy lifting equipment to install. Further, it places additional stress on the supporting walls, which may limit the extent to which features such as windows and doors can be accommodated. Also, bulkier and/or more complex roof structures can look unsightly and take up more room, limiting the space available beneath.

In addition, it is clear that in either of the above examples, substantial skill is required in building a conventional building or conservatory roof structure. For instance, each part of the structure must be produced within relatively precise tolerances, and the roof must be designed and assembled so that the stress from the weight of the roof is propagated correctly. Building such roofs therefore requires the expertise of professional builders, incurring substantial costs. Further, the use of professional builders brings with it the risk of unexpected delays and/or additional costs.

In either of the above roof designs, the eaves beam may take the form of a box beam, that is to say a beam of hollow cross section formed by joining together four elongate sheet members into an elongate cuboidal 'box'. When a box beam undergoes a bending moment, it functions in a similar fashion to an I beam, with adjacent surfaces on opposite sides of the neutral axis functioning as the flanges and resisting largely shear forces, and with the surfaces connecting these adjacent surfaces functioning as the web and largely resisting bending stresses. Use of box beams may decrease the weight of the eaves beams, however attaching other beams or components to box beams can be more difficult due to the beams' hollow section, as traditional joints, such as dovetail joints, are unsuitable. Specialist brackets may therefore be required, which in turn can add cost and increase the complexity of the design and assembly processes.

It is therefore an object of the invention to obviate or mitigate at least one of the aforesaid disadvantages, and/or to provide an improved or alternative roof.

According to the present invention there is provided a roof for a building, the roof comprising:

- a ridge beam for defining an upper edge of the roof;
- a first eaves beam for defining a lower edge of the roof;
- a first panel connectable to both the ridge beam and the eaves beam, being capable of spanning the distance therebetween and extending over at least a first portion of the area of the roof; and
- one or more retention structures positionable relative to the first panel and one of said beams and configured to clamp said panel against the other of said beams.

A roof according to the invention may weigh less than a conventional roof of the same size, therefore it may require no (or fewer) other support components. Further, the roof may be of sufficient strength to negate or minimise the need for additional support in order for the structure to be able to withstand the force of tiling, insulation, glazing, etc., placed on top.

This lack (or minimisation) of additional support required can not only decrease the weight further (simplifying shipping and assembly, and placing less stress on the supporting walls), but can also improve the aesthetics of the roof and provide more space in the room beneath. This simplified structure may be quicker to install due to its use of fewer components, and fewer or none of these requiring shaping on site (for instance the roof may be capable of being supplied entirely in kit form). This simplicity may also allow the roof to be assembled by less highly skilled (and therefore cheaper) workers. Indeed, it is believed that in many situations, a roof utilising the present invention may be delivered and assembled by two handymen with a van. The risk of unexpected costs or delays would therefore be minimised.

For the avoidance of doubt, a roof as defined above may be the entire roof of a structure or may be a part thereof. Where it is the latter, the upper and lower edges of the roof of the present invention may or may not correspond to the upper and/or lower edges of the entire roof. One or more of said beams may be formed from more than one section of beam joined together.

In one embodiment, the or each retention structure may comprise a mechanically-operable jack mechanism configured to urge apart the first panel and the beam relative to which the or each retention structure is positionable, so as to urge the first panel towards the other beam. Such a mechanism may offer an advantageously quick and simple mechanism by which the panel can be clamped into position. Alternatively, the or each retention structure may take any other suitable form. For instance, each may be a resilient member positioned and deformed such that its restorative force acts to urge the first panel and the beam apart. The or each retention structure may instead act to urge the first panel and said beam towards each other.

In the above embodiment, the or each retention structure may be positionable relative to the ridge beam and be mechanically operable to urge the first panel towards the first eaves beam. The panel being urged in this direction to clamp it may allow a proportion of the panel's weight to contribute to the force with which it is clamped to the first eaves beam, minimising the force which must be generated by the retention structure(s).

In another embodiment, the roof may further comprise a second panel also connectable to both the ridge beam and the eaves beam, being capable of spanning the distance therebetween and extending over at least a second portion of the area of the roof. The second panel may increase the total roofing area that can be covered. Further, the roof may comprise three, four or more panels, each being connectable to both the ridge beam and the eaves beam, being capable of spanning the distance therebetween and extending over portions of the area of the roof.

In the above embodiment the roof may further comprise a second eaves beam, each of the first and second eaves beams being locatable on opposite sides of the ridge beam; the first panel being connectable to the first eaves beam and to the ridge beam; and the second panel being connectable to the second eaves beam and to the ridge beam. Such an arrangement may advantageously increase the space under the roof for a given surface area of floor space beneath, i.e. a vaulted ceiling in the structure/building being roofed is desirably achievable.

Alternatively, or in addition, in the above embodiment each of the first and second panels may be clampable by a common retention structure. This may minimise parts cost and roof assembly time in comparison to arrangements where each of the panels is clamped by a separate retention structure.

Instead or in addition, in the above embodiment the or each retention structure may comprise a mechanically-operable jack mechanism configured to urge apart the first panel and the second panel. For instance, each retention structure may be positionable relative to the ridge beam and mechanically operable to urge each of the first panel and the second panel towards the first eaves beam and the second eaves beam respectively. As explained previously, a mechanically-operable jack mechanism may offer an advantageously quick and simple mechanism by which the panel can be clamped, and the panels being urged towards their respective eaves beams may allow a proportion of their weight to contribute to the force with which they are clamped to their respective eaves beams. The retention structure may alternatively take any other suitable form, such as those given above.

In either of the above embodiments; the or each retention structure may comprise a first strut member and a second strut member, each strut member having a first end and a second end; the first end of the first strut member may be adapted to be coupled to the first panel; and the first end of the second strut member may be adapted to be coupled either to the beam relative to which the retention structure is positionable, or to the second panel. This arrangement may provide an advantageously simple and/or adaptable mechanism by which the or each retention structure can function. The first and second strut members may or may not be substantially identical.

Said first and second strut members may be hingedly attachable to one another about their respective second ends by a pivot. The pivot may be operable so as to urge apart the second ends of the strut members to urge apart the first panel, and the beam relative to which the retention structure is positionable or the second panel. The pivot may be so operable via a lead screw mechanism. This arrangement may provide a particularly simple and universally understood mechanism by which the or each retention structure may be operated. Alternatively, the pivot may be operable by any other mechanism, such as by hydraulics or pneumatics, via a ball screw or roller nut screw, or by a linear actuator.

In the present invention, the or each panel may be simultaneously clampable by a plurality of retention structures. This may provide advantageous redundancy, mitigating catastrophic failure in the event of one retention structure failing (since the panel will still be clamped in place by the remaining one or more retention structures). It may also allow each retention structure to provide only a portion of the total clamping force, which in turn may allow the retention structures to be lighter in weight and/or less expensive in their manufacture.

A roof according to the invention may further comprise one or more hip beams, each for defining an edge of the roof and being configured to extend from the ridge beam to one end of an eaves beam, wherein one or more retention structures are positionable relative thereto. Use of hip beams may allow roofs according to the present invention to be built in a wider variety of structural forms. They may also provide advantageously inconspicuous additional support to the roof. Retention structures being positioned on the hip beams may allow the panels to be more firmly clamped in place, may spread the clamping force between more retention structures as explained previously, and/or may allow panels to be clamped in two different directions simultaneously. The hip beams may be substantially identical to the ridge beam and/or eaves beam(s).

Beneficially, each panel may comprise one or more mounting elements for attachment to a beam. For instance, the or each panel and the ridge beam may each be provided with mutually engageable hooking structures. A panel provided with one or more such mounting elements may provide an advantageously simple and/or self-contained attachment mechanism. Provision of mutually engageable hooking structures on the ridge beam and the panels may allow panels to be hooked in place on the ridge beam before being secured into position. This may simplify the assembly process and/or decrease the chances of a panel accidentally detaching from the ridge beam during assembly of the roof. Alternatively, the mounting elements may take the form of an abutment structure or a projection for receipt within a recess (or a recess for receipt of a projection), or may take any other suitable form. In any event, the mounting elements may be made of any suitable material such as a metal (for example aluminium) or a polymer. The mounting elements may be sections of an extrusion, such as a lightweight aluminium extrusion.

The or each panel comprised in a roof according to the invention may be of composite structure, for instance it or they may be made of fibreglass or carbon fibre. Preferably, however, the or each panel is a structural insulated panel ("SIP"). A composite panel may have an advantageous strength to weight ratio, and/or may be manufactured with advantageous ease. Use of structural insulated panels may provide such advantages, and furthermore may be of wide availability and/or low cost, and may provide the roof with beneficial thermal and/or acoustic properties. Alternatively, the or each panel may be any other solid or hollow sheet-like component (flat or otherwise), and may be made from any other suitable material (such as aluminium, a polymer, plywood or oriented strand board). Each panel may have a mass of less than 25 $kg/m^2$, preferably less than 20 $kg/m^2$ and more preferably less than 15 $kg/m^2$.

Moreover, the roof may further comprise a glazed section. The glazed section may comprise one or more glazed windows cut into one of the aforesaid panels or cooperatively defined by two or more adjacent such panels. Alternatively, the glazed section may be formed by locating one or more glazing bars adjacent the said panel or panels, with glazing material located therebetween, in known manner. A roof incorporating such a glazed section may be considered more aesthetic and therefore of wider applicability to the extensions and conservatories market.

In some instances, a roof according to the invention may further comprise at least one substantially vertical leg for supporting the or each eaves beam. For instance, the or each eaves beam may be supported by two vertical legs, one at either end. Use of such legs may allow less or none of the weight of the roof to be taken by the walls, placing fewer or no restrictions on the structural integrity thereof. When so provided, the or each substantially vertical leg may be suitably incorporated into the structure and construction of the walls located below the roof.

Advantageously, the ridge beam, and/or the or each eaves beam, may be a structural beam of polygonal cross section comprising:

- at least three sheet members;
- at least one fixed-angle connector for connecting two sheet members at a fixed relative angle, and
- at least two pairs of hingedly cooperative connectors, each pair for connecting two sheet members at a variable relative angle, so as to enable completion of the polygonal cross section.

Due to the range of relative angles which may be afforded by the pairs of hingedly cooperative connectors, such a beam may be pre-made to a required specification with little alteration in tooling and assembly, increasing the adaptability of a roof according to the invention. For instance, if the beam must span a distance with particularly little sag its vertical height may easily be increased, thereby increasing its first moment of area and therefore its stiffness. Additionally, the beam may be of advantageously low weight and/or high strength, and thus provide one or more of the advantages discussed above. Further, use of such a beam may allow assembly of the roof to be simplified further, reducing the skill level required of those assembling a roof according to the invention.

As used herein, a "sheet member" is any component of sheet-like geometry. Each sheet member may or may not be hollow, uniform and/or planar in shape. Reference to the polygonal shape of the beam's cross section should not be construed as including only flat-sided polygons or only regular polygons. One or more surfaces of one or more of the sheet members may be complex in shape and/or arcuate in cross section. Each sheet member is preferably made of a material with a density not exceeding 700 kg/m$^3$, such as oriented strand board.

One or more of the sheet members may provide an abutment surface against which at least the first panel may be clampable. This may provide an advantageously simple panel attachment mechanism, and/or one in which the clamping force may be applied over a larger area of the panel and structural beam. Further, it may negate or minimise the need for specialised mounting brackets. Mounting a panel via an abutment surface may also be beneficial in that the angle of the panel can be adjusted according to required specifications simply by altering the relative sizes of the sheet members of the structural beam, thereby altering the angle of the abutment surface.

Each connector comprised in a structural beam of polygonal cross section may be elongate and preferably aligned substantially parallel to the longitudinal axis of said beam. Connectors of this type may provide additional strength to the structural beam.

A structural beam of polygonal cross section may be of quadrilateral cross section, and comprise two fixed-angle connectors and two pairs of hingedly cooperative connectors. Alternatively, it may be of pentagonal cross section and comprise three fixed-angle connectors and two pairs of hingedly cooperative connectors. These structures may exhibit advantageous strength and/or adaptability of design. For instance, a beam of pentagonal cross-section may exhibit greater flexibility of geometry, while a beam of quadrilateral cross section may be constructed more quickly and out of fewer parts.

One or more of the connectors may comprise a complementary mounting element for engagement with one or more panels. Mounting elements being present on one or more of the connectors may allow the force applied by the attached panels to be distributed across a greater area of the structural beam than, for example, if a mounting element were bonded to one of the sheet members. Further, such mounting elements may provide redundancy in panel attachment (each panel being both clamped to the structural beam and attached to it via the mounting elements). Further, they may provide assistance in assembly. For instance, one connector may have a mounting element in the form of a short shelf on which the panel can be rested before being clamped into position.

The sheet members may be arranged peripherally to define an elongate cavity of polygonal cross section within the beam. This cavity may advantageously reduce the weight of the beam, and/or provide a space for thermal or acoustic insulation material to be located. The cavity may contain support structures such as one or more struts, webs, ties, and/or sections of structural foam or honeycomb material. The support structures may be evenly distributed along the length of the cavity, or may be concentrated about points where the beam undergoes increased loading (for example in regions where other components are mounted to the beam).

For a better understanding, the present invention will now be more particularly described, by way of non-limiting example only, with reference to and as shown in the accompanying drawings (not to scale) in which.

Figure 1:
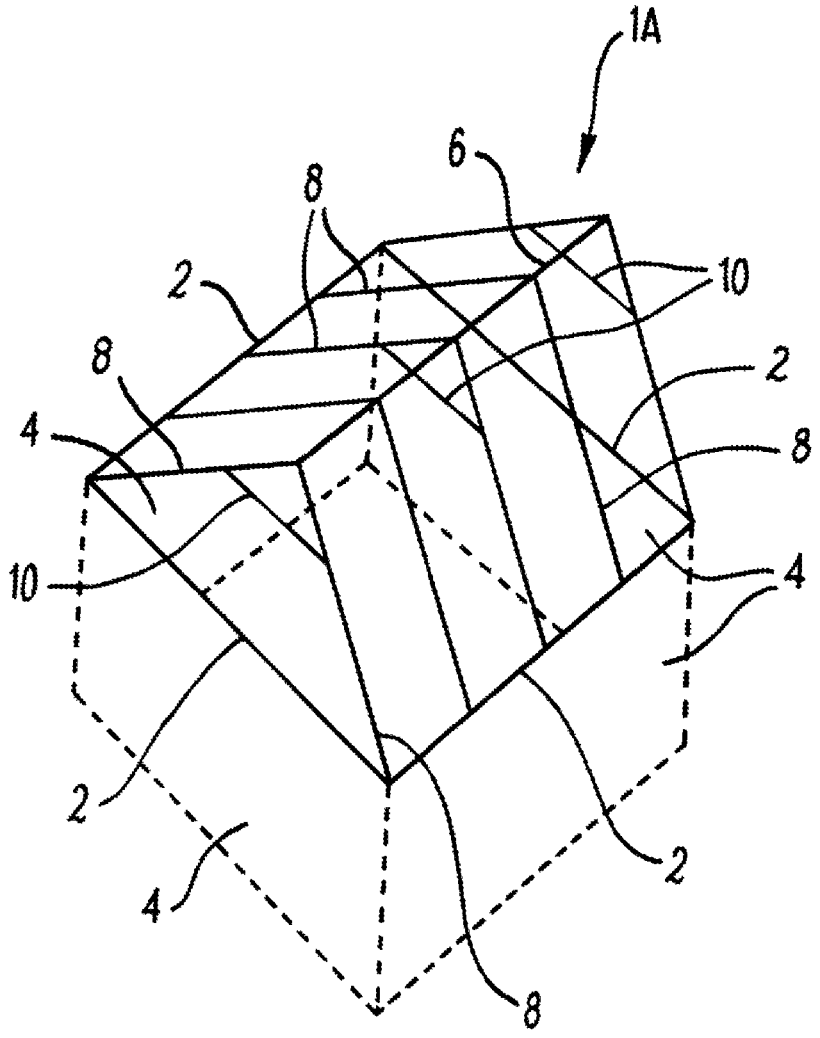
FIG. 1 is a perspective view of the structure of a conventional roof.

FIG. 1 shows the skeleton of an exemplary generic roof 1A of the type described above, in position atop a structure shown in dotted outline. An eaves beam 2 runs along the top of each wall 4 of the structure, defining the perimeter of the roof 1A. In this case a single ridge beam 6 defines the top edge of the roof. The ridge beam is supported by a number of rafters 8, which also support a roof covering (not shown) such as tiles, insulation and breather membrane that can be fitted above. The rafters 8 are arranged in pairs along the length of the ridge beam 6, usually at a predetermined spacing, and alternate pairs of rafters 8 are provided with additional structural support in the form of a collar tie 10. One or more walls 4 beneath the roof may not be of uniform construction, and may incorporate features such as windows and/or doors.

Figure 2:
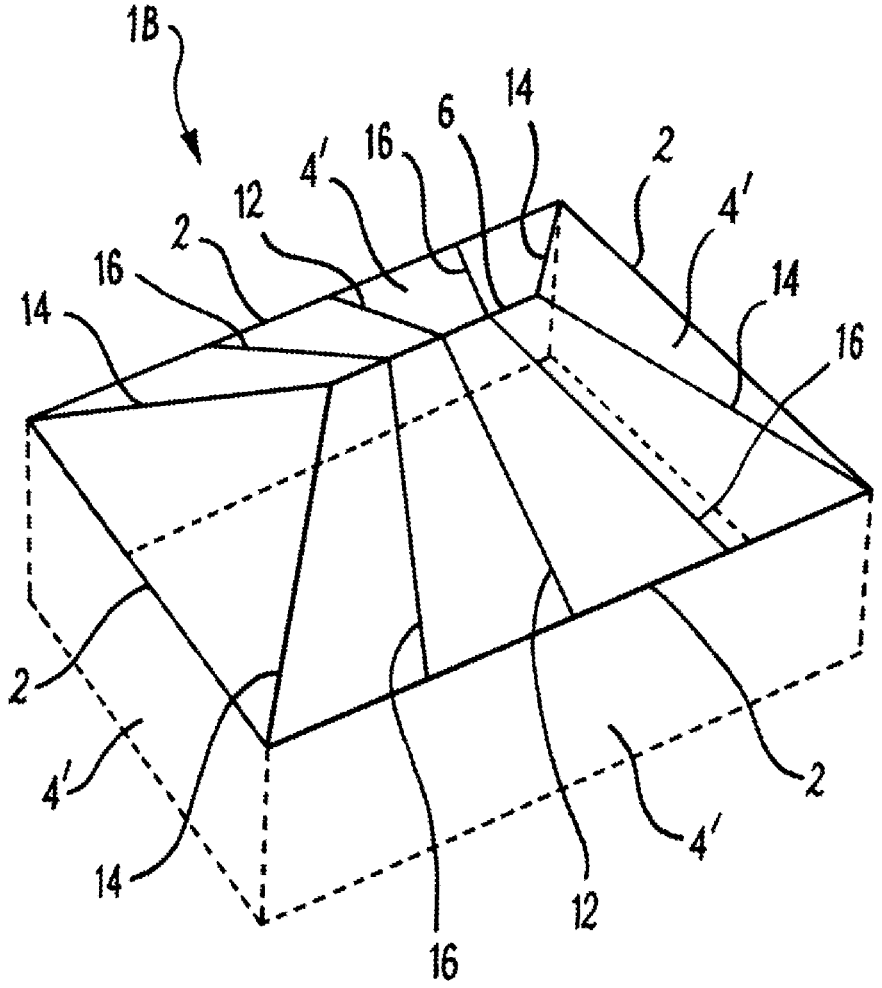
FIG. 2 is a perspective view of the structure of a conventional glazed roof.

A skeleton of an exemplary glazed conservatory roof 1B as described previously is shown in FIG. 2 in position atop a conservatory structure shown in dotted outline. As with the generic roof shown in FIG. 1, the glazed roof 1B has eaves beams 2 running along the top of the conservatory walls 4' to define its perimeter, and a ridge beam 6 defining its top edge. In this case the ridge beam 6 is supported by glazing bars of three different types:

- a glazing bar referred to herein as a "transom glazing bar" 12, which extends at a substantially 90° angle to both the ridge beam 6 and the eaves beam 2 to which it is attached;
- a glazing bar referred to herein as a "hip glazing bar" 14 (a type of "hip beam"), which extends along a diagonal edge of the roof, from an end of the ridge beam 6 to a corner at which two eaves beams 6 meet; and
- a glazing bar referred to herein as a "splay glazing bar" 16, which extends at a non-90° angle to both the ridge beam 6 and the eaves beam 4 to which it is attached.

Between the glazing bars 12, 14, 16, panes of glazing material (not shown) are supported. Again, one or more conservatory walls 4' beneath the roof may not be of uniform construction, and will usually incorporate features such as windows and/or doors.

Figure 3:
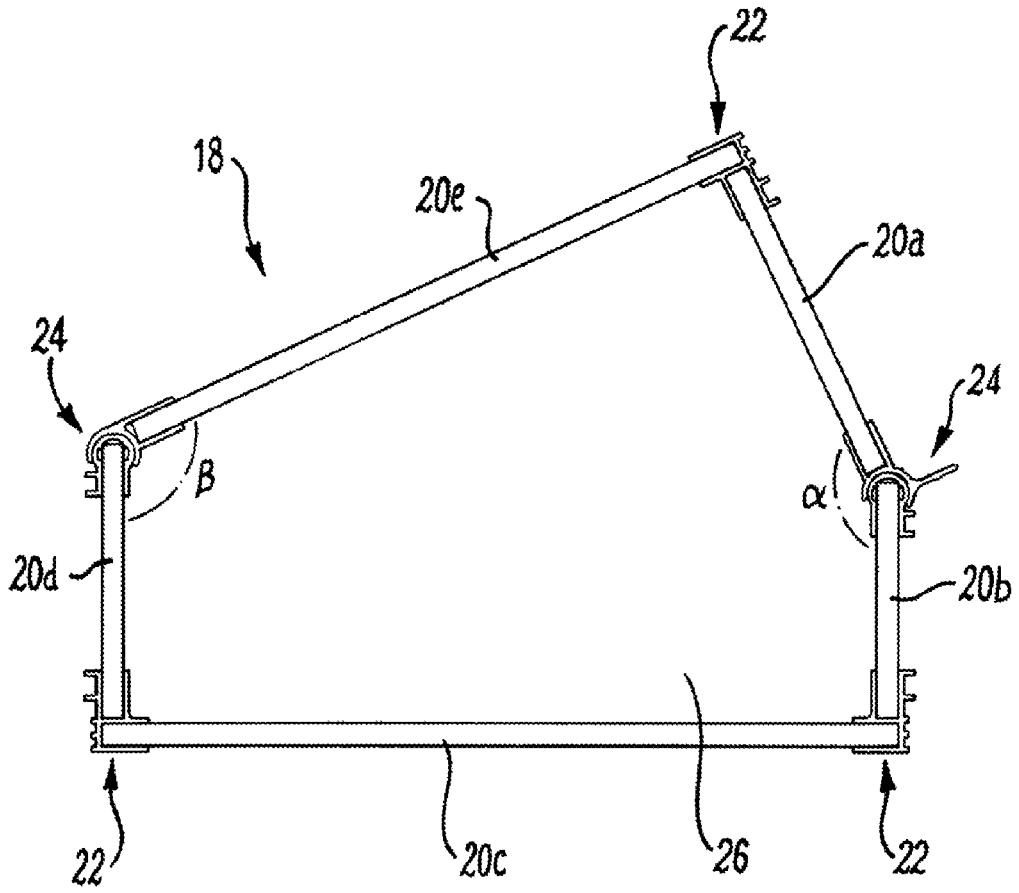
FIG. 3 is a cross-sectional end view of a structural beam of polygonal cross-section used as an eaves beam in a roof according to an embodiment of the invention.

FIG. 3 shows a cross-section of a structural beam of polygonal cross section 18, which is used as an eaves beam in the described embodiment of the invention. The beam 18 is constructed from five sheet members 20*a*-20*e*, interconnected by connectors to form an elongate beam (its longitudinal axis being normal to the page from the perspective of FIG. 3) of polygonal cross section. The beam 18 of this embodiment has three elongate fixed-angle connectors 22, one connecting sheet members 20*a* and 20*e*, one connecting sheet members 20*b* and 20*c* and one connecting sheet members 20*c* and 20*d*. The beam 18 also has two pairs 24 of elongate, hingedly cooperative connectors, one pair connecting sheet members 20*a* and 20*b* and one pair connecting sheet members 20*d* and 20*e*. Being formed from five sheet members 20*a*-20*e*, the beam 18 has a non-uniform pentagonal cross sectional shape. The sheet members 20*a*-20*e* are arranged co-operatively to enclose a cavity 26 in the centre of the beam. The cavity 26, being enclosed by the inner faces of the pentagonally-arranged sheet members, is also of pentagonal cross section.

Figure 4:
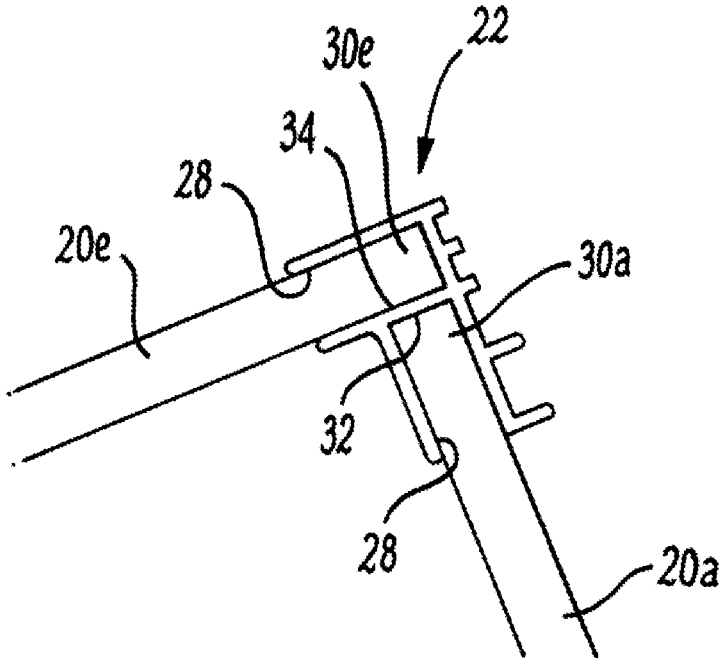
FIG. 4 is a cross-sectional end view of a fixed-angle connector of the structural beam of FIG. 3.

FIG. 4 shows in more detail the fixed-angle connector 22 that joins sheet members 20*a* and 20*e*. The fixed-angle connector 22 is elongate, its longitudinal axis being normal to the page from the perspective of FIG. 4. It therefore runs parallel to the longitudinal axis of the beam. The connector 22 has two slots 28, each of which is adapted to receive a lateral end 30*a*, 30*e* of one of the sheet members 20*a*, 20*e*. The shape and relative orientation of the two slots 28 determines the relative position of the two sheet members 20*a*, 20*e*. In this embodiment the slots are at substantially 90° to each other and the base 32 of one slot 28 is adjacent to the inner side 34 of the other joint. The sheet members 20*a*, 20*e* are therefore positioned substantially orthogonally relative to one another, and their lateral ends 30*a*, 30*e* are positioned in a relationship akin to a butt joint. In the embodiment the connectors 22, 24 are bonded in place using an adhesive such as epoxy resin, but in other embodiments they may be held in place by friction fit, via serrations or using fasteners, or in any other suitable fashion.

As illustrated in FIG. 3, in this embodiment each of the fixed-angle connectors 22 are substantially identical in cross-section and are all aligned with their longitudinal axes parallel to that of the beam 18. This substantially identical cross section allows them all to be made using substantially the same tooling and methodology, which can simplify production and assembly processes due to greater parts interchangeability. Further, each fixed-angle connector 22 is preferably a section of an extrusion, in this case made of aluminium alloy. Their identical nature therefore allows them to be produced using the same extrusion die, and indeed allows them to be cut from the same extrusion.

Figure 5:
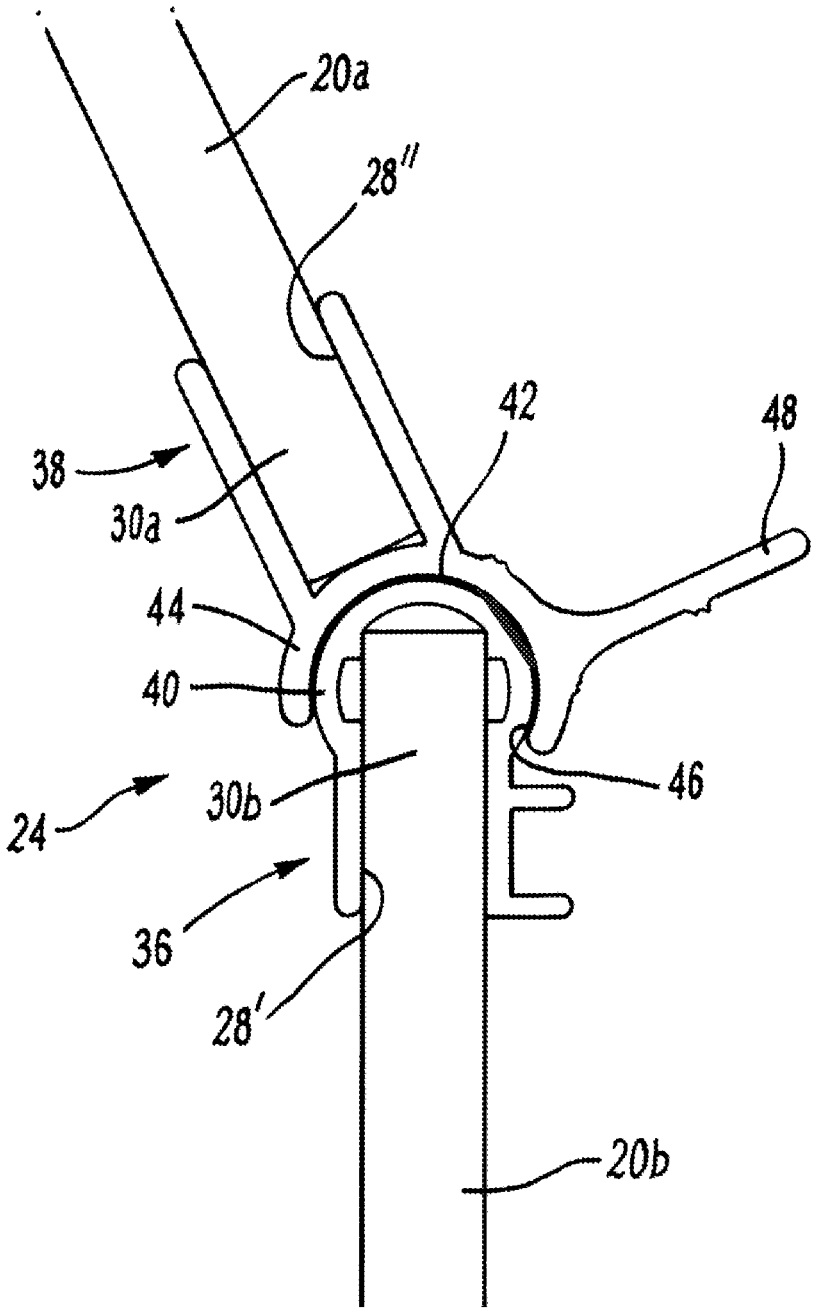
FIG. 5 is a cross-sectional end view of a pair of hingedly cooperative connectors of the structural beam of FIG. 3.

FIG. 5 shows in more detail the pair 24 of hingedly cooperative connectors which connect sheet members 20*a* and 20*b*. The pair 24 comprises an axle connector 36 and a socket connector 38, each of which is elongate with its longitudinal axis being normal to the page from the perspective of FIG. 5. Each therefore also runs parallel to the longitudinal axis of the beam. The axle connector 36 has a slot 28', which is adapted to receive a lateral end 30*b* of a sheet member 20*b*, and an axle element 40 with a convex bearing surface 42. The socket connector 38 also has a slot 28" adapted to for receiving a lateral end 30*a* of a sheet member 20*a*. Further, socket connector 38 has a socket element 44 with a concave bearing surface 46. The axle element 40 of the axle connector 36 and the socket element 44 of the socket connector 38 are complimentarily shaped to form a hingedly rotatable coupling. In other words, the socket connector 38 is rotatable relative to the axle connector 36, about a rotational axis defined by the axle element (the rotational axis being parallel to the longitudinal axis of the axle connector 36, and therefore parallel to the beam 18). The sheet members 20*a*, 20*b* connected by the pair 24 of hingedly cooperative connectors are therefore rotatable relative to one another, allowing the angle between them (shown as angle $\alpha$ in FIG. 3) to be varied. The socket connector 38 mounted on sheet member 20*a* has a mounting element 48. The mounting element 48 of this embodiment takes the form of a short shelf used for mounting a panel, as outlined below.

In this embodiment, the concave bearing surface 46 of the socket connector 38 extends though just over 180°. This allows the axle connector 36 and socket connector 38 to be clipped together by inserting the axle element 40 into the socket element 44. Inserting the axle element 40 forces the socket element 44 to flex slightly to allow the axle element to enter, after which it springs back to its original shape and rotatably retains the axle element.

Though the hingedly cooperative connectors of each pair 24 are configured to be rotatable relative to one another, the range of motion of one or more pairs may be limited. In some situations, hinged cooperation between one or more pairs 24 may be substantially prevented, securing the pair (and therefore the sheet members mounted thereto) at a particular angle. For instance, in situations where the beam 18 is to undergo substantial load, it may be preferable for all pairs 24 of hingedly cooperative connectors to be secured at a predetermined relative angle. Fixing the relative angle of a pair 24 of hingedly cooperative connectors essentially transforms the pair into a single fixed-angle connector. Limitation or prevention of relative movement of a pair 24 of hingedly cooperative connectors can be brought about in any suitable fashion, for instance by gluing, soldering, brazing or welding the pair 24 of connectors together. Alternatively, the pair 24 of connectors may be limited or fixed in their relative rotation by one or more fasteners such as screws.

Figure 6:
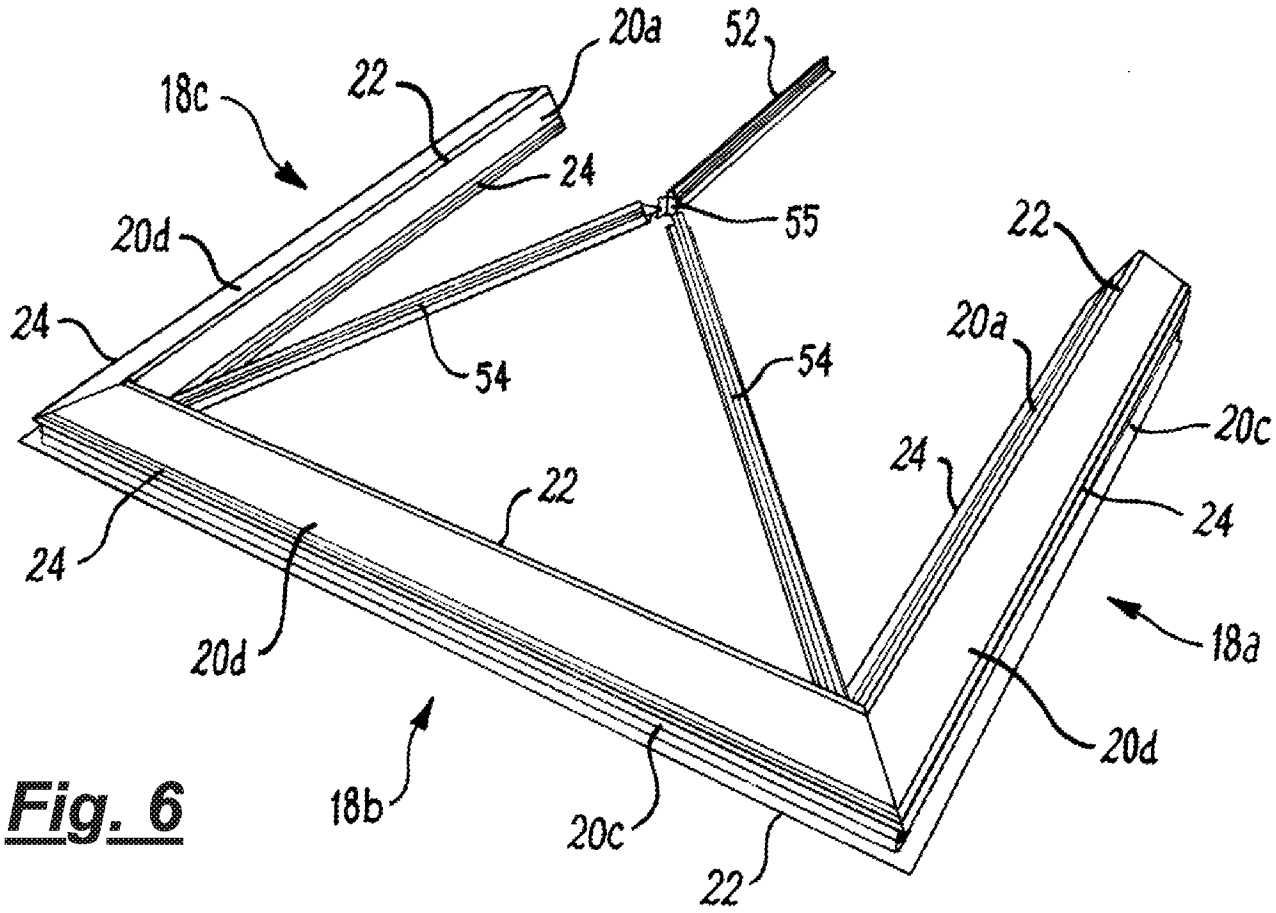
FIG. 6 is a perspective view of the skeleton of a roof according to the embodiment.

FIG. 6 shows the skeleton of a roof according to the embodiment of the invention. The roof has an elongate ridge beam 52 which defines an upper edge of the roof. Three structural beams of polygonal cross section 18*a*-18*c* (as described above) serve as eaves beams, each defining a bottom edge of the roof. The roof has two hip beams 54. Each hip beam runs from the ridge beam 52 to the end of an eaves beam 18*a*-18*c*, defining a diagonal edge of the roof therebetween. One hip beam 54 connects at the junction between eaves beams 18*a* and 18*b* (therefore can be thought of as extending to the end of eaves beam 18*a* or to the end of eaves beam 18*b*) and the other connects at the junction between eaves beams 18*b* and 18*c* (therefore can be thought of as extending to the end of eaves beam 18*b* or to the end of eaves beam 18*c*). The hip beams 54 and the edge beam 52 intersect at a three-way connector 55.

Figure 7:
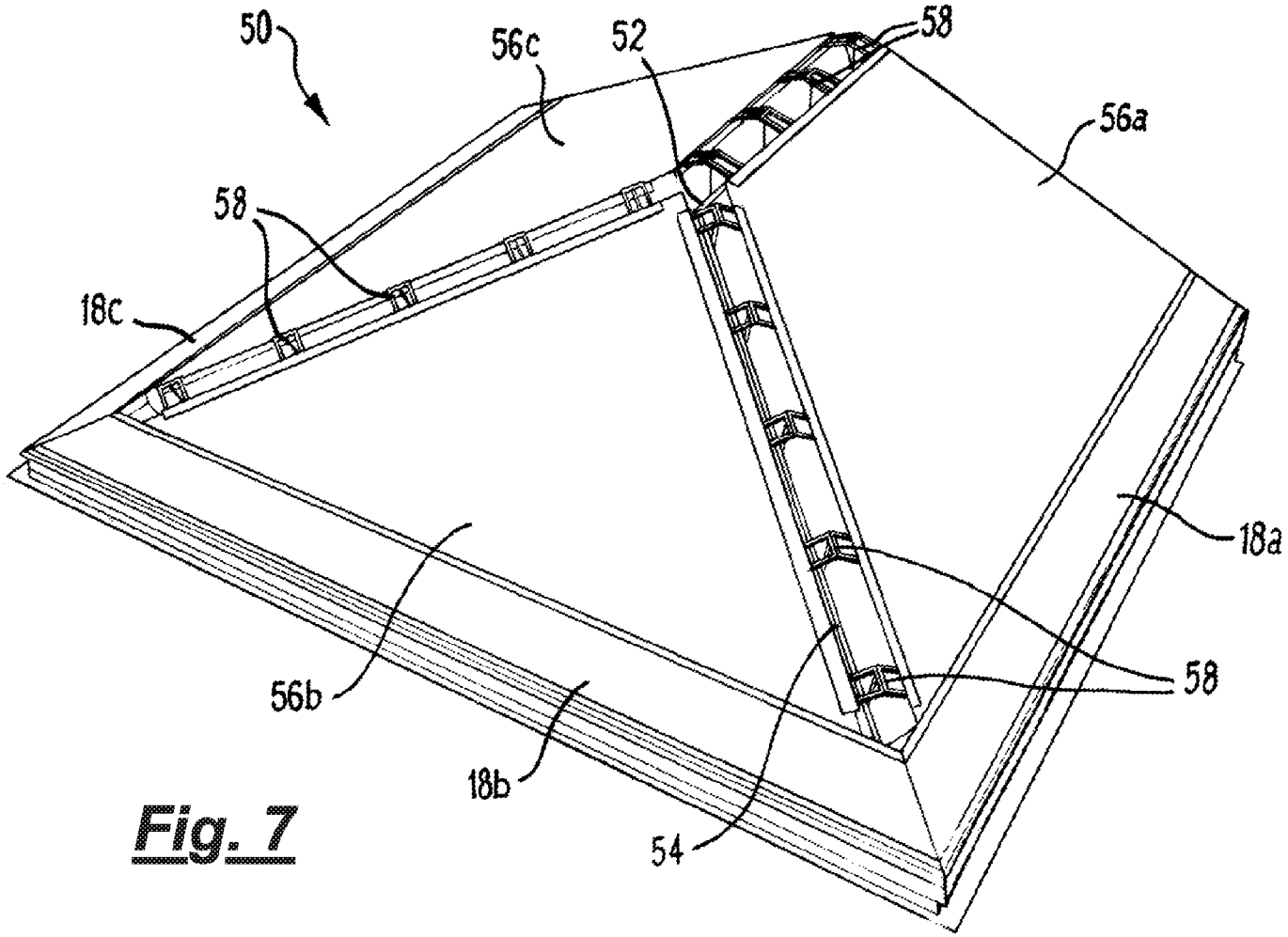
FIG. 7 is a perspective view of the roof according to the embodiment.

FIG. 7 shows the entire roof 50 of this embodiment of the invention. The roof also comprises three panels 56*a*-56*c*, each of which extends over a portion of the area of the roof. Each panel 56*a*-56*c* is connected to the ridge beam 52 (only a small portion of which is visible in FIG. 7) and to one of the eaves beams 18*a*-18*c*, spanning the distance between said beams, and in this embodiment each panel is connected to at least one of the hip beams 54 (only a small portion of one of which is visible in FIG. 7). More particularly, panel 56*a* is connected to one side of the ridge beam 52 (the nearer side from the perspective of FIGS. 6 and 7), to eaves beam 18*a* and to one of the hip beams 54. Similarly, panel 56*c* is connected to the other side of the ridge beam 52 (the far side from the perspective of FIGS. 6 and 7), to eaves beam 18*c*, and to the other hip beam (not visible in FIG. 7). Panel 56*b* is connected to the end of ridge beam 52, by the three-way connector (reference 55 in FIG. 6), is connected to eaves beam 18*b*, and is connected to both hip beams 54.

The roof 50 further comprises a plurality of retention structures 58, each of which is configured to clamp a panel against one of the beams to which it is connected. More specifically, in this embodiment some retention structures 58 are positioned (in this case physically mounted) on the ridge beam 52 and the others are positioned (mounted) on the hip beams 54. In either case, in this embodiment the retention structures 58 are configured to urge the panels 56*a*-56*c* towards the eaves beams 18*a*-18*c* to which they are connected via a mechanically-operable jack mechanism, which is illustrated in later figures and discussed in more detail below.

Figure 8:
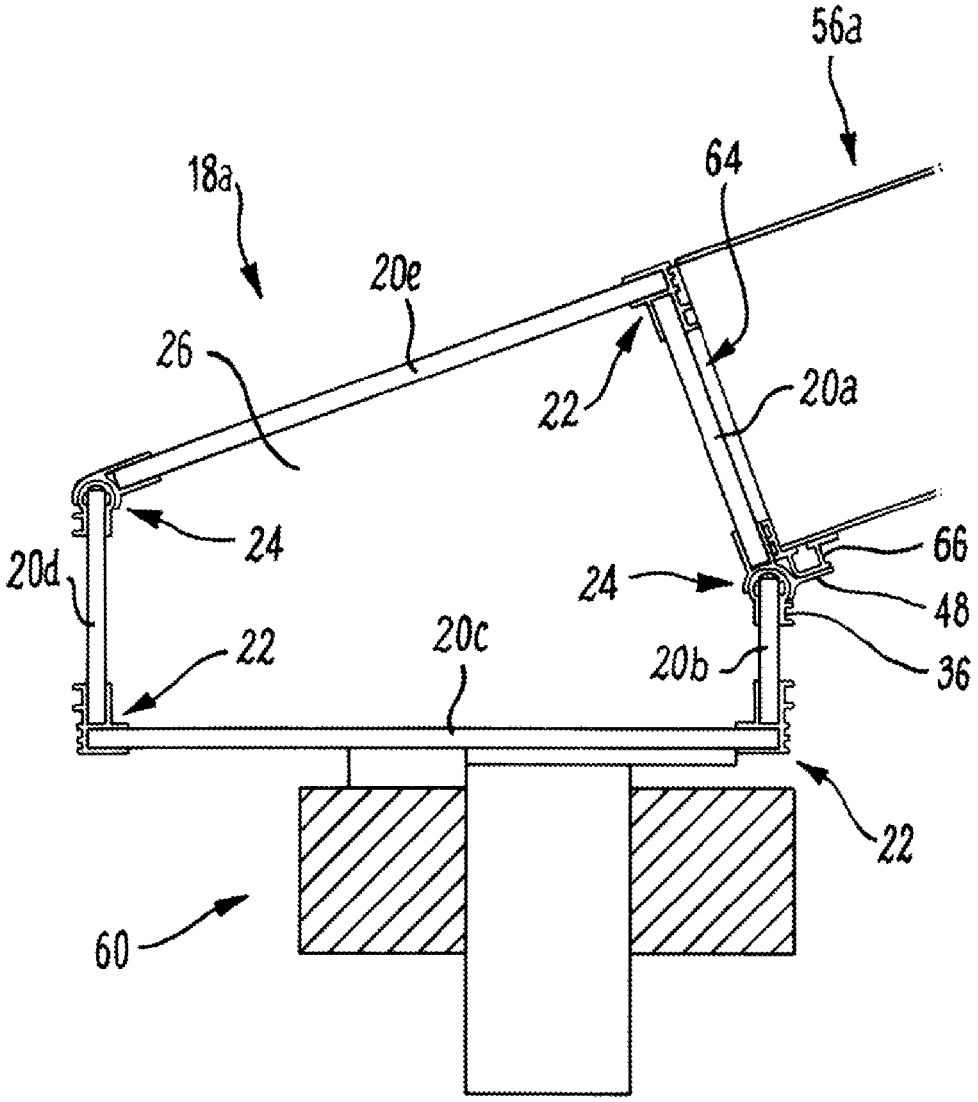
FIG. 8 is a cross-sectional end view of the structural beam of FIG. 3 with a panel clamped thereto.

FIG. 8 shows a more detailed view of the connection between panel 56*a* and structural beam 18*a*, and also shows the beam in position on top of a wall (generally denoted 60). Sheet member 20*a* (along with the connectors 22, 24 attached thereto) defines an abutment surface 64 against which the panel 56*a* is positioned. The panel 56*a* is clamped against the abutment surface 64 by retention structures (not visible in FIG. 8) and additionally rests on the mounting element 48 described previously. In this embodiment the panel 56*a* has an elongate mounting strip 66 which rests on the mounting element 48 of the beam 18*a*. For additional structural rigidity a plurality of screws (not shown) are driven through the mounting element 48 of the beam 18*a* and into the mounting strip 66 of the panel 56*a* to secure it in position. In this embodiment, the mounting element 48 functioning as a shelf also enables the panel 56*a* to be rested in place before being clamped and secured as described above, simplifying the assembly process of the roof.

With panels 56*a*-56*c* mounted as described above, it is clear that the angle of the roof determines the required angle of the panel, which in turn determines the angle at which sheet member 20*a* must be held. Given that the angle of roofs can vary considerably, the flexibility in beam geometry which can be provided by the present invention may be particularly advantageous when the beam is to be used in such an application. Due to the range angles which can be accommodated by the pairs 24 of hingedly cooperative connectors, the angle of sheet member 20*a* can be varied simply by altering the dimensions of one or more of sheet members 20*b*-20*e*. For example, if a beam 18 in which sheet member 20*a* was nearer to vertical was required, this could be achieved (for instance) by increasing the vertical height of sheet member 20*d* and reducing the horizontal width of sheet member 20*c*. The internal angle (shown as angle $\beta$ in FIG. 3) between sheet members 20*d* and 20*e* would therefore be decreased, and the internal angle $\alpha$ between sheet members 20*a* and 20*b* would be increased (these changes being accommodated within the range of motion of the pairs 24 of hingedly cooperative connectors), therefore sheet member 20*a* would be nearer vertical.

In situations where the weight of the beam 18*a* is of most concern, the connectors 22, 24 may be of minimal length and the cavity 26 may be empty. In the first embodiment however, each of the connectors 22, 24 runs substantially the entire length of the beam. Further, the cavity 26 is filled with polyurethane foam (not shown) and has a plurality of intermediate support structures (not shown) spaced along its length. The polyurethane foam provides structural support to the sheet members 20*a*-20*e*, improving the load-bearing capabilities of the beam 18*a*. The foam also acts as thermal insulation and sound-proofing. The support structures (not shown) take the form of substantially planar webs aligned normal to the longitudinal axis of the beam. Each is of complementary polygonal shape to that of the cavity 26 such that it fits inside with minimal clearance. The web therefore acts to hold the sheet members 20*a*-20*e* apart, preventing the beam from buckling. In addition, each web is bonded to the inner surfaces of the sheet members 20*a*, 20*e* such that it acts to prevent the sheet members being pulled apart from each other.

Figure 9:
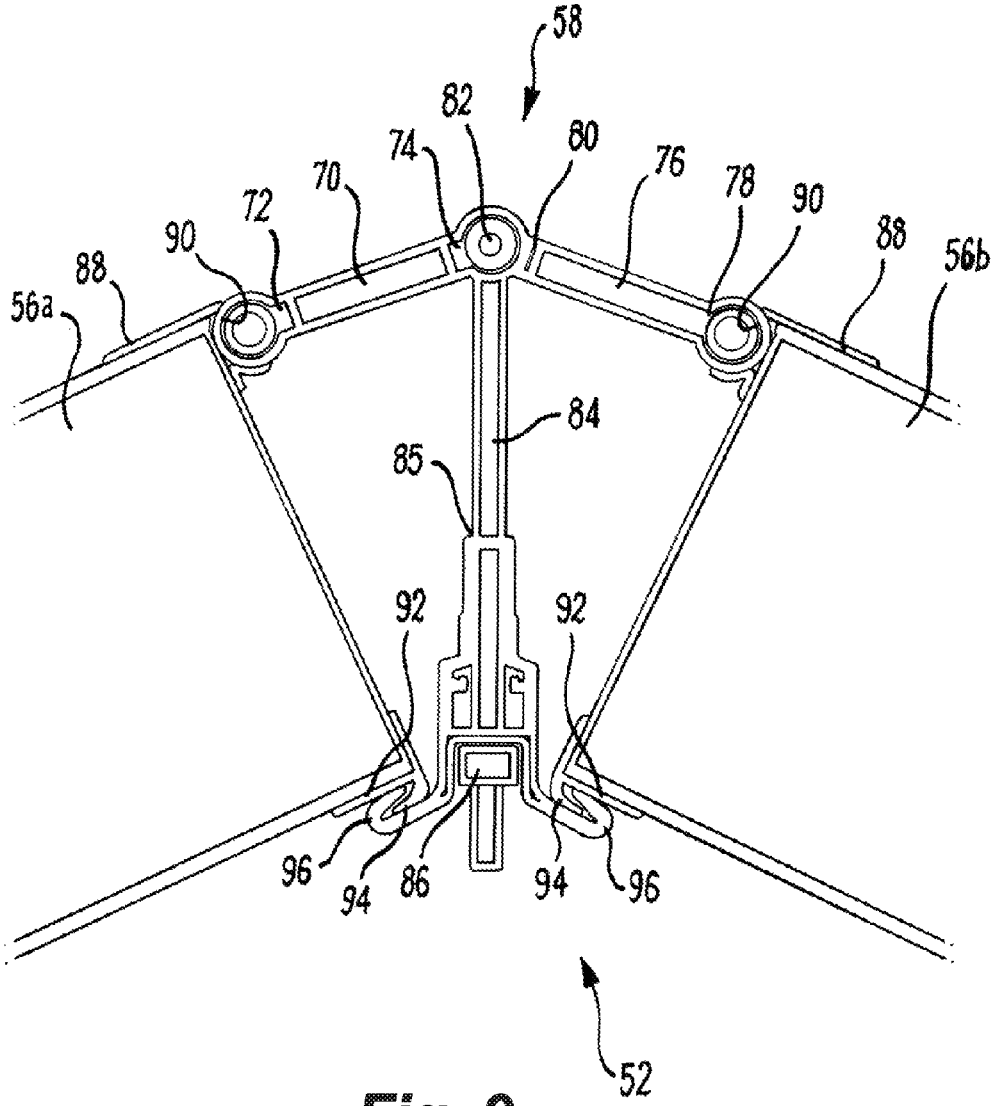
FIG. 9 is an end view of a ridge beam of the roof of FIG. 7 with panels connected thereto.
Figure 10:
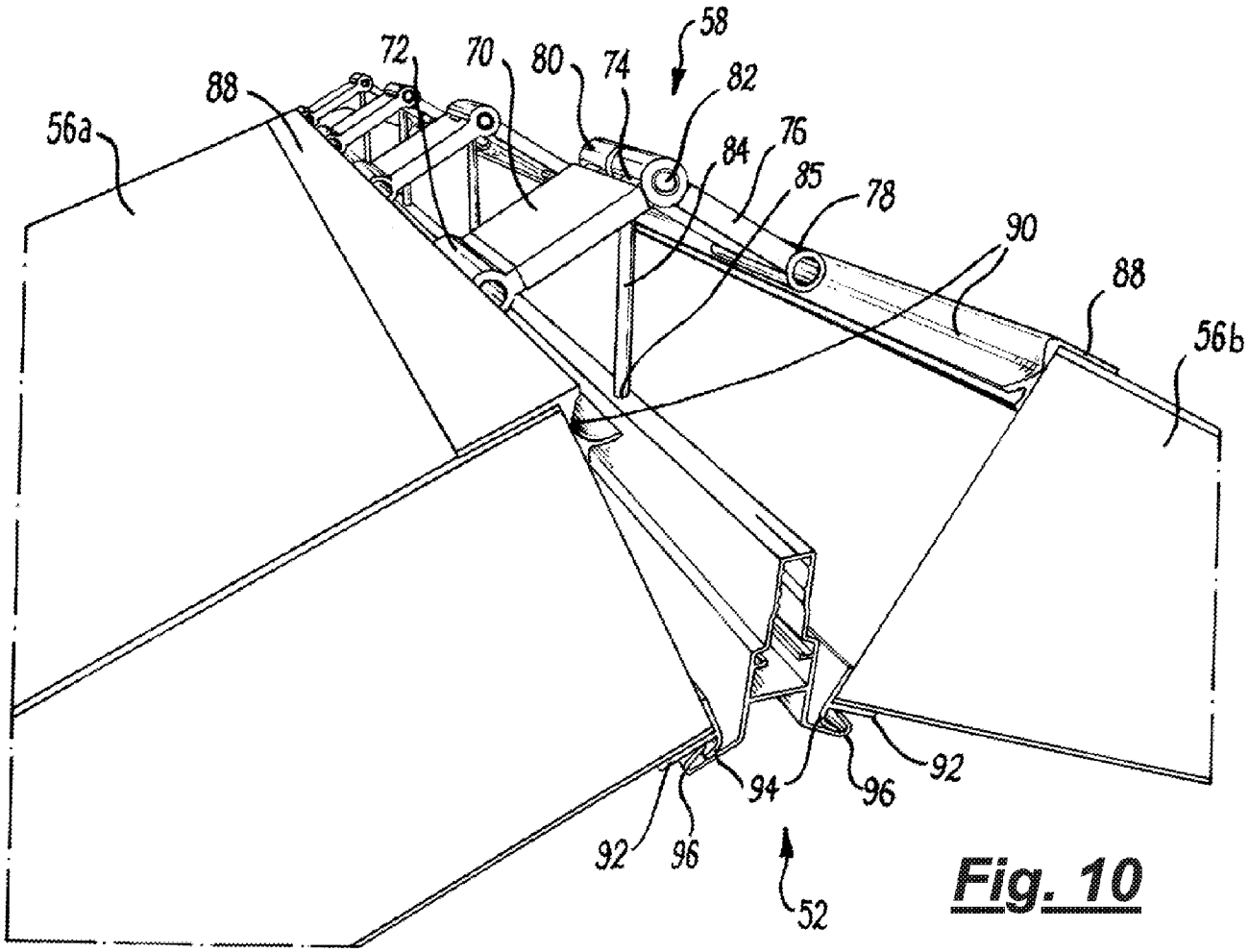
FIG. 10 is a perspective view of the ridge beam and panels of FIG. 9.

FIGS. 9 and 10 show a retention structure 58 and the ridge beam 52 in more detail. Referring to these figures in combination, each retention structure 58 has a first strut member 70 with a first end 72 and a second end 74, and a second strut member 76 with a first end 78 and a second end 80. The strut members 70, 76 are connected together at their respective second ends 74, 80 by a pivot 82. The strut members can rotate relative to one another about the pivot 82, forming a hinge. The first end 72 of the first strut member 70 is pivotably connected to a clamp connector 88 on one panel 56*a*, and the first end 78 of the second strut member 76 is pivotably connected to a clamp connector 88 on the other panel 56*b*. In this embodiment, these pivotable connections are formed by the first ends 72, 78 of the strut members 70, 76 being rotatably received within indentations 90 in the clamp connectors 88.

An elongate threaded rod 84 is connected to the pivot 82. In this embodiment the longitudinal axis of the threaded rod 84 is at approximately 90° to the rotational axis (about which the struts 70, 76 can rotate) of the pivot 82. The threaded rod 84 passes through a bore 85 in the ridge beam 52 and is threadedly engaged by a rotatable nut 86 (not visible in FIG. 10). The threaded rod 84 and the nut 86 cooperatively form a lead screw mechanism. By rotating the nut 86 in one direction the threaded rod 84 can be urged downwardly, and by rotating the nut in the opposite direction the threaded rod can be allowed to move upwardly.

To clamp the panels, the nut 86 is rotated so as to urge the threaded rod 84 downwardly, which in turn urges the pivot 82, which is attached to the threaded rod 84 (and which prevents the threaded rod from rotating with the nut), downwardly. Moving the pivot 82 downwardly causes the first strut member 70 to rotate (clockwise from the perspective of FIG. 9), with its first end 72 rotating within the indentation 99 in the clamp connector 88 on panel 56*a*, and causes the second strut member 76 to rotate in the opposite direction, with its first end 78 rotating within the indentation 99 in the clamp connector 88 on panel 56*b*. As the strut members 70, 76 counter-rotate, they move towards an extended position and their respective second ends 72, 78 move further apart. This urges the panels 56*a*, 56*b* further apart, clamping them against the abutment surfaces of the eaves beams (not visible) to which they are connected. In this embodiment, each clamp connector 88 extends over a significant portion of the top surface of the panel 56*a*, 56*b* to which it is attached. This is of particular importance in embodiments where the panel 56*a*, 56*b* has a thin structural top skin (as discussed below), as it provides a greater area of interface between the connector and panel, allowing the force applied by the connectors to be propagated through the panel and preventing damage. Further, each connector 88 runs across substantially the entire length of the edge of the panel 56*a*, 56*b* to which it is attached. This spreads the clamping force further, and in embodiments where the panels 56*a*, 56*b* have strengthening ribs (as discussed below) allows the connector to act a structural member spanning between the ribs.

As also shown in FIGS. 9 and 10, the ridge beam 52 is engageable with the panels 56*a*, 56*b* connected thereto. Each panel 56*a*, 56*b* has a ridge beam connector 92, which comprises a hooking structure 94. These hooking structures 94 are configured for engagement with complementary hooking structures 96 on the ridge beam 52. As outlined above, these hooking structures allow the panels 56 to be hooked into place before being clamped, rather than having to be supported (e.g. by temporary scaffolding) until clamped into place.

As shown more clearly in FIG. 9, the hooking structures 94, 96 provide a degree of slidable clearance when they are engaged. In other words, when not being clamped each panel is able to slide slightly (around 10 mm in either direction) towards or away from the ridge beam 52. This clearance may therefore allow the components of the roof assembly to be produced to less exacting tolerances. Though this slidable clearance may be beneficial during assembly, once the panels 56 have been clamped in their final position it may be preferable to prevent any further sliding between the engaged hooking structures 94, 96 in order to increase the rigidity of the structure. This may be done by welding, bonding, brazing or soldering the pairs of engaged hooking structures 94, 96 together, or using fasteners such as screws. In other circumstances, it may be beneficial for the slidable clearance to remain uninhibited, for instance in order to better allow for heat expansion.

Returning to FIG. 7, it will be apparent that the retention structures 58 located on the hip beams 54 are of the same form as those on the ridge beam 52. These retention structures 58 function in the same away as described above. Further, it should be noted that each hip beam 54 has corresponding features to those described above in relation to the ridge beam 52, and indeed the beams 52, 54 are substantially identical in cross section. In this embodiment the ridge beam and each hip beam are each a section of an extrusion (in this case made of aluminium alloy), and the hip beams 54 being substantially identical in cross section to the ridge beam 52 allows them to all be cut from the same extrusion (thus saving on tooling costs and increasing parts interchangeability).

FIG. 7 also shows that each panel 56*a*-56*c* is clamped by a plurality of retention structures 58. Further, each retention structure 58 clamps a plurality of panels 56 (in this case two). This arrangement may provide the advantages outlined above.

Figure 11:
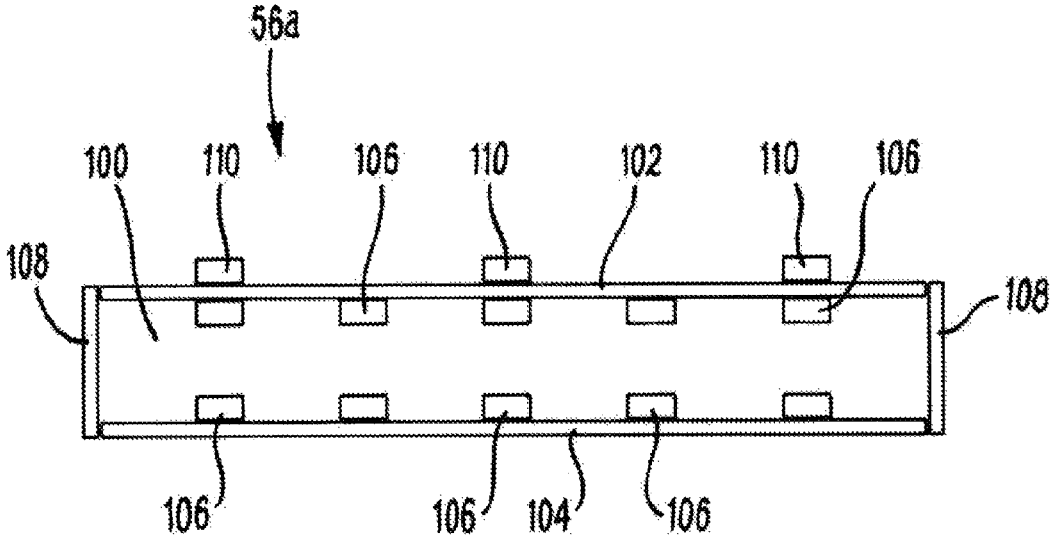
FIG. 11 is a cross sectional view of a panel used in the roof of the embodiment.

In this embodiment, each panel 56 has a composite structure. More specifically, each takes the form of a structural insulated panel ("SIP"). FIG. 11 shows a cross-section of panel 56*a*, viewed along the panel in the direction of its span (i.e. normal to the eaves beam 18*a* or ridge beam 52). The panel has a thermally insulating core 100, which in this embodiment is made out of expanded polystyrene. The core 100 is encased by a top skin 102 and a bottom skin 104, each of which is made out of particleboard. The panel functions in a similar manner to a box beam as described above, with the top and bottom skins 102, 104 resisting mainly shear forces and the core 100 resisting mainly bending stresses. The panel 56*a* also has laterally spaced internal ribs 106, in this case made out of timber, which provide additional strength and rigidity to the panel. Further, it has side skins 108 in the form of layers of polyurethane sealant. These protect the exposed sides of the core from moisture ingress.

FIG. 11 also shows a set of counter battens 110 which are attached externally of the panel 56*a* in register with at least some of the internal ribs 106 via screws (not visible).

The counter battens 110 act as a support surface and/or mounting point for other roofing components such as tiling battens, membrane or further insulation.

One advantage of using structural panels such as SIPs is their rigidity. In some structures, notably structures such as conservatories and extensions where one wall of the structure is considerably more rigid (such as the wall of house to which the conservatory/extension is annexed), wind loading can cause the shape of the structure to deform (for instance a square room may be deformed into a rhombus). In conventional structures the walls must be constructed to be sufficiently rigid (and rigidly connected) so as to resist deformation from wind loading. In some embodiments of the invention, however, sufficient rigidity can be provided by the roof itself acting as a diaphragm and holding the walls of the structure in the correct orientation.

Though it is believed that the majority of this diaphragm action is provided by the bottom surfaces of the panels, in some circumstances it may be beneficial to increase the roof's strength and/or rigidity by securing the top surfaces of the panels to the ridge beam and/or eaves beams. For example, to attach the panels to the eaves beams, counter battens 110 mounted on the panels may extend beyond the panels' lower edges, overlying the eaves beams (e.g. lying across sheet member 20*e*) and being secured thereto. Alternatively, separate brackets (such as sheet components or T-sections) may overlap the panels and eaves beams and be bonded or fastened to each, connecting them together. With reference to FIGS. 9 and 10, the top surfaces of the panels 56*a*, 56*b* may be secured to the ridge beam 52 by driving self-drilling screws (not visible) through the clamp connectors 88 of the panels 56*a*, 56*b* and into the first ends 72, 78 of the strut members 70, 76. This may have the additional effect of coupling panels 56*a*, 56*b* together, allowing tensile forces (such as those that may be present when the roof acts as a diaphragm as explained above) to be transmitted between them.

Figure 12:
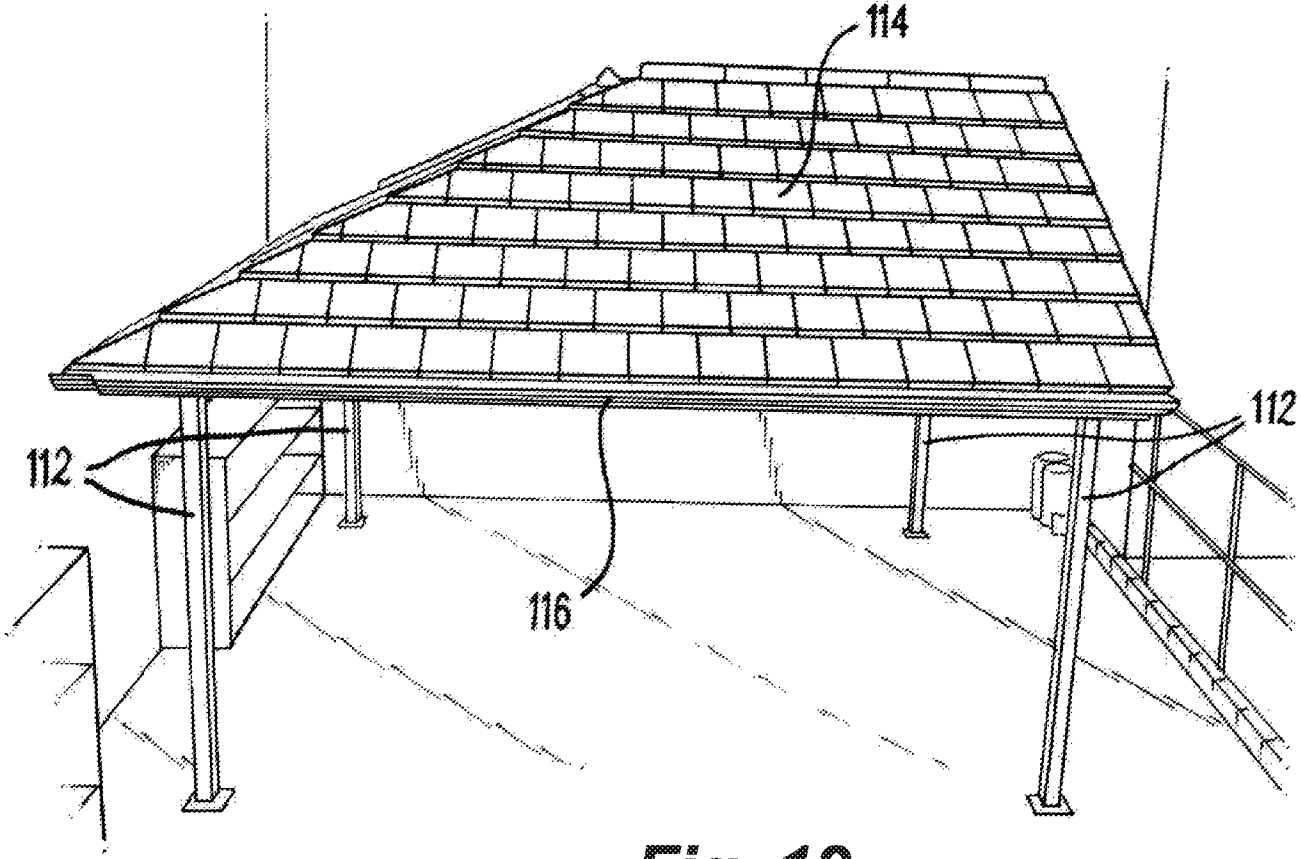
FIG. 12 is a perspective view of the roof of the embodiment mounted on vertical legs.

The rigidity of roofs such as those utilising SIPs may also place fewer requirements on the wall. In particular, the roof may be rigid enough for less or no lateral loading to be applied to the wall (in contrast to a more flexible roof, where the weight of the roof causes it to sag, which in turn urges the tops of the walls outwards). The roof can therefore be built on walls of less structural strength, as the walls must merely support the vertical weight of the roof. Further, in some situations the roof may be supported on vertical legs. FIG. 12 shows the roof of the embodiment mounted on four vertical legs, 112, in this case made of steel box-section. In this embodiment each eaves beam (not visible) is supported by a leg 112 at each end (the two legs to the left of the figure each supporting the ends of two eaves beams where those ends meet). In other embodiments however, any other suitable arrangement may be used. For instance, each eaves beam may be supported by one leg positioned mid-way along its length, or the roof may nonetheless be positioned on top of structurally rigid walls. With the roof supported by vertical legs, it is possible for the roof to place no stress at all on the walls, which must then merely support their own weight. FIG. 12 also shows the roof in finished condition, with tiling 114 and guttering 116 fitted.

It will be appreciated that numerous modifications to the above described design may be made without departing from the scope of the invention as defined by the appended claims. For instance, though the mounting elements discussed herein are each part of a connector or common sheet member, in other embodiments the mounting elements may take any suitable form. For instance, they may take the form of mouldings or bent sheet brackets bonded to a sheet member or attached thereto via fasteners.

Furthermore, though each pair of hingedly cooperative connectors described above comprise an axle connector and a socket connector, they may take any other suitable form. For instance, each connector of a pair may be rotatable relative to the other via a flexure bearing or a knife-edge bearing. Further, one or more localised areas of one or more of the sheet members of a structural beam of polygonal cross section may be thickened by bonding an additional layer to its internal and/or surface. These thickened areas may be coincident with support structures, where present, and/or in locations where additional components may be attached (for instance by driving fasteners through the additional component and into the thickened section).

In the above embodiment, the elongate mounting strips (reference 66 in FIG. 8), clamp connectors and ridge beam connectors (references 88 and 92 respectively in FIGS. 9 and 10) each extend along the substantially the entire length of an edge of the panel, thereby providing maximum support. In other embodiments however, one or more of them may be short sections distributed about the panel where connection to the panel in question is required, and/or they may not run along an edge of the panel.

In other embodiments where a structural beam of polygonal cross section such as that described above is used as an eaves beam, roofing structures may be mounted differently. For instance, referring back to FIG. 8 the external surface of sheet member 20*e* (and the connectors 22, 24 attached thereto) may function as an abutment surface against which panels are fitted. Alternatively or in addition, components may be fitted solely to one or more of the connectors 22, 24, with none of the sheet members 20*a*-20*e* providing an abutment surface. In some situations, the above mounting mechanisms (or any other) may be used in combination. For instance, the beam 18 may function as an eaves beam in a partially glazed roof, with panels 56 for the non-glazed portion mounted against sheet member 20*a* and glazing bars (not shown) for the glazed portion mounted with their undersides against sheet member 20*e*. In this arrangement, sheet members 20*a* and 20*e* being held substantially orthogonally by the fixed-angle connector 22 therebetween is beneficial as it ensures that the glazing beams (not shown) and panels 56 are aligned parallel to one another.

In relation to FIGS. 9 and 10, reference to the pivot moving 'up' and 'down' should not be construed as limiting. Depending on the configuration and orientation of the retention structures, the pivot may move in any suitable direction in order to affect clamping. Further, it is to be understood that the lead screw mechanism may take any other suitable form. For instance, the nut may be rotationally fixed, with the threaded rod being movable axially by rotating it. Alternatively, the pivot may comprise the nut, and may be movable by rotating a threaded rod which is axially fixed.

Though in the above embodiment each retention structure acts on two panels, in other embodiments each may act on a beam and a single panel. Said beam may have an indentation for receipt of the first end of the second strut member.

Figure 13:
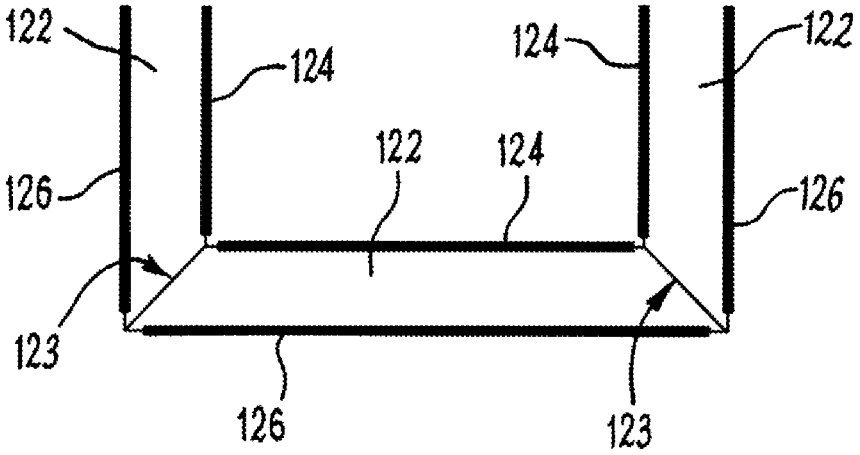
FIG. 13 is a plan view of three exemplary structural beams connected by miter joints.

For the avoidance of doubt, where reference is made to connectors extending substantially the entire length of the beam, this refers to connectors that extend substantially the entire length of the edge of the beam to which they are attached. For example, as shown in FIG. 13, where two beams 122 intersect at a miter joint 123, a connector 124 on the inside edge of a beam may be significantly shorter than a connector 126 one on the outside edge of the beam. Nonetheless, both such connectors extend substantially the entire length of the beam as defined herein. The above also holds where connectors may be of different lengths due to the beam being curved. Further, connectors which exhibit one or more breaks along their length may still be considered to extend along substantially the entire length of a beam. For instance, each connector may comprise two or more pieces aligned in series (for instance a 4 m long beam may have a single connector made out of two 2 m long sections), and/or a connector may be slightly shorter than the beam, for instance to provide clearance at a joint 123 (as is shown in FIG. 13). The above also holds in relation to mounting strips, clamp connectors and ridge beam connectors running along substantially the whole length of an edge of a panel.

It is to be understood that the SIP described above is examplary. A SIP is any panel comprising an insulating core sandwiched (directly or indirectly) between structurally-supportive skins. A SIP may or may not have ribs and/or side skins. The ribs, where present, may be on one or both sides of the panel, and may be regularly or irregularly distributed. Instead of or in addition to ribs, a SIP may have one or more webs running the full thickness of the core (i.e. in contact with both the top and bottom skins).

Further, the materials indicated should not to be construed as limiting. The top and bottom skins (and side skins, where present) may instead be made of plywood, metal such as aluminium, timber, a polymer, a composite material such as carbon fibre or fibreglass, fibreboard such as hardboard or oriented strand board, or any other suitable material. The different skins may or may not be made of the same material and/or have the same thickness as other skins. The insulating core may also be made of any suitable material. For instance, it may be made of polyisocyanurate foam, mineral wool, polyurethane foam or sheep's wool. The core may be bonded to one or more of the skins by an adhesive, or by fusing the core to the skin(s) while one is in a plastic or molten state. In the case of the latter bonding mechanism, SIPs may be brought to the worksite, or even assembled into a roof according to the invention, before injecting the core material into the panel.

The described and illustrated embodiments are to be considered as illustrative and not restrictive in character, it being understood that only preferred embodiments have been shown and described and that all changes and modifications that come within the scope of the invention as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims.

The invention claimed is:

1. A roof for a building, the roof comprising:

a ridge beam defining an upper edge of the roof;

a first eaves beam defining a lower edge of the roof;

a first panel connected to both the ridge beam and the eaves beam, and spanning the distance therebetween and extending over at least a first portion of the area of the roof; and one or more retention structures positioned relative to the first panel and one of said beams and configured to clamp said panel against the other of said beams, wherein each of the one or more retention structures comprises a mechanically-operable jack mechanism configured to urge apart the first panel and the one of said beams relative to which the retention structure is positioned, so as to urge the first panel towards the other of said beams, wherein each of the one or more retention structures further comprises a first strut member and a second strut member, each strut member having a first end and a second end, wherein the first end of the first strut member is coupled to the first panel and the first end of the second strut member is coupled to the one of said beams relative to which the retention structure is positioned;

wherein the first and second strut members are hingedly attached to one another about their respective second ends by a pivot;

wherein the pivot is operable by the mechanically-operable jack mechanism so as selectively to urge apart the first ends of the strut members to urge apart the first panel and the one of said beams relative to which the retention structure is positioned and to urge the first panel and the one of said beams relative to which the retention structure is positioned towards each other.

2. A roof structure according to claim 1 wherein each of the one or more retention structures is positioned relative to the ridge beam and is mechanically operable to urge the first panel towards the first eaves beam.

3. A roof according to claim 1 further comprising a second panel also connected to both the ridge beam and the eaves beam, and spanning the distance therebetween and extending over at least a second portion of the area of the roof, and further comprising a second eaves beam, each of the first and second eaves beams being located on opposite sides of the ridge beam, the first panel being connected to the first eaves beam and to the ridge beam, and the second panel being connected to the second eaves beam and to the ridge beam;

wherein each mechanically-operable jack mechanism included in each of the one or more retention structures is configured to urge apart the first panel and the second panel;

wherein each of the one or more retention structures is positioned relative to the ridge beam and is mechanically operable to urge each of the first panel and the second panel towards the first eaves beam and the second eaves beam respectively;

wherein first end of the second strut member is further coupled to the second panel;

wherein the pivot is operable by the mechanically-operable jack mechanism to urge apart the first ends of the strut members to urge apart the first panel and the second panel or to urge the first panel and the second panel towards each other.

4. A roof according to claim 3 wherein each of the first and second panels are clamped by a common retention structure.

5. A roof according to claim 1 wherein the pivot is operable via a lead screw mechanism.

6. A roof according to claim 1 wherein the first panel is simultaneously clamped by a plurality of the one or more retention structures.

7. A roof according to claim 1 further comprising one or more hip beams, each for defining an edge of the roof and being configured to extend from the ridge beam to one end of an eaves beam, wherein the one or more retention structures is positioned relative thereto.

8. A roof according to claim 1 wherein the first panel comprises one or more mounting elements attached to a beam.

9. A roof according to claim 8 wherein the first panel and the ridge beam are each provided with mutually engaged hooking structures.

10. A roof according to claim 1 wherein the first panel is of composite structure.

11. A roof according to claim 10 wherein the first panel is a structural insulated panel.

12. A roof according to claim 1 further comprising a glazed section.

13. A roof according to claim 1 further comprising at least one substantially vertical leg supporting the caves beam.

14. A roof according to claim 1 wherein the ridge beam, and/or the eaves beam, is a structural beam of polygonal cross section comprising: at least three sheet members; at least one fixed-angle connector connecting two sheet members at a fixed relative angle, and at least two pairs of hingedly cooperative connectors, each pair connecting two sheet members at a variable relative angle, so as to complete the polygonal cross section.

15. A roof according to claim 3 wherein each panel is simultaneously clamped by a plurality of the one or more retention structures.

16. A roof according to claim 3 wherein each panel comprises one or more mounting elements attached to a beam.

17. A roof according to claim 16 wherein the first and second panels and the ridge beam are each provided with mutually engaged hooking structures.

18. A roof according to claim 3 wherein each panel is of composite structure.

19. A roof according to claim 18 wherein each panel is a structural insulated panel.

20. A roof according to claim 1, wherein the first end of the first strut member is pivotally coupled to the first panel, and the first end of the second strut member is pivotally coupled to the beam relative to which the retention structure is positioned.

21. A roof according to claim 3, wherein the first end of the first strut member is pivotally coupled to the first panel, and the first end of the second strut member is pivotally coupled to the second panel.

* * * * *